US007789684B2

(12) United States Patent
Magden, Jr.

(10) Patent No.: US 7,789,684 B2
(45) Date of Patent: Sep. 7, 2010

(54) 5PINPROAUDIO SSW1

(76) Inventor: Dan L. Magden, Jr., 540 N. 83rd St., Seattle, WA (US) 98103

( * ) Notice: Subject to any disclaimer, the term of this patent is extended or adjusted under 35 U.S.C. 154(b) by 0 days.

(21) Appl. No.: 12/057,261

(22) Filed: Mar. 27, 2008

(65) Prior Publication Data

US 2009/0246994 A1 Oct. 1, 2009

(51) Int. Cl.
*H01R 29/00* (2006.01)

(52) U.S. Cl. ..... 439/166; 439/49; 200/5 R

(58) Field of Classification Search ..... 439/166, 439/170, 171, 49, 651, 638; 200/51 R, 51.06, 200/52 R, 49, 1 R, 11 G, 11 R, 14, 5 R
See application file for complete search history.

(56) References Cited

U.S. PATENT DOCUMENTS

| | | | | |
|---|---|---|---|---|
| 4,158,114 | A * | 6/1979 | Butler et al. | 200/1 R |
| 4,362,905 | A * | 12/1982 | Ismail | 379/442 |
| 4,817,153 | A * | 3/1989 | Fernandez | 381/26 |
| 5,108,315 | A * | 4/1992 | Vogl et al. | 439/651 |
| 7,581,970 | B2 * | 9/2009 | Englund | 439/171 |
| 2008/0179953 | A1 * | 7/2008 | Reese et al. | 307/38 |

* cited by examiner

*Primary Examiner*—Tho D Ta
*Assistant Examiner*—Travis Chambers
(74) *Attorney, Agent, or Firm*—Priya Sinha Cloutier

(57) ABSTRACT

Generally, camera have two channels—one and two. A channel is used by hardwiring the output to a particular channel. The Switch allows the cameraman to switch between channel one and two without hardwiring the equipment.

1 Claim, 2 Drawing Sheets

5PINPROAUDIO SSW1

CROSS-REFERENCES TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND

A professional video camera ("Camera"), also referred to as a Television camera, is a high-end device for recording in an electronic format (as opposed to a movie camera, that records the images on film). Originally developed for use in television studios, they are now commonly used for corporate and educational videos, music videos, and direct-to-video movies.

Most, if not all, Cameras have a 5-pin XLR connector allowing for two-channel audio output. However, the 5-pin XLR must be hardwired for a particular channel. Hardwiring requires, in most cases, an engineer to solder custom cable wires into the system in order to use one channel or the other. In order to switch channels, the hardwired pin must be manually changed.

For a Camera to provide 2 channels of audio output, two female-end 5-pin XLRs, at a cost of approximately $8.00 each, two 3-pin XLRs, at a cost of approximately $5.00 each, must be purchased. The correct pins must then be hardwired onto the Camera. The engineer hired to do this work paid anywhere from $25 to $60 per hour. It takes an experienced engineer approximately one hour to complete wiring for one channel. Because Cameras are usually carried from one site to another and face a multitude of environments, wear and tear on the hardwiring can be significant. If the hardwired connection fails on-site, and no engineer is there to repair it, the Camera will be rendered useless. This issue can be resolved by the use of a switch, allowing the cameraman to easily change from one channel to the other without the need for hardwiring the XLR connector.

The current invention, called the 5PinProAudio SSW1, provides such a switch. The 5PinProAudio SSW1 will allow the user to change audio channels with a simple flick of a switch, alleviating the need for time and resources spent on hardwiring cameras, and the danger of failure in the field.

BRIEF SUMMARY OF THE INVENTION

The current invention allows the user of a Professional or Television camera switch audio channel output without the need to hardwire the channels.

BRIEF DESCRIPTION OF THE SEVERAL VIEWS OF THE DRAWINGS

Other features and advantages of the present invention will become apparent in the following detailed descriptions of the preferred embodiment with reference to the accompanying drawings, of which.

DETAILED DESCRIPTION OF THE INVENTION

The current invention, a 5-pin to 3-pin XLR switch ("Switch"), is described more fully hereinafter with reference to the accompanying drawings, in which preferred embodiments of the invention are shown. This invention may, however, be embodied in many different forms and should not be construed as limited to the embodiments set for herein; rather, these embodiments are provided so that this disclosure will be thorough and complete and will fully convey the scope f the invention to those skilled in the art.

Balance audio output from a camera requires 3 wires: Hi, Low, and Common. The purpose of the Common wire is to block out signal interference. Generally, cameras have two channels—one and two. However, in order to utilize both channels, the user must hardwire channel one and two separately; hardwires must be changed to use a particular channel. The Switch allows the cameraman to switch between channel one and two without hardwiring the equipment.

Figure 1:
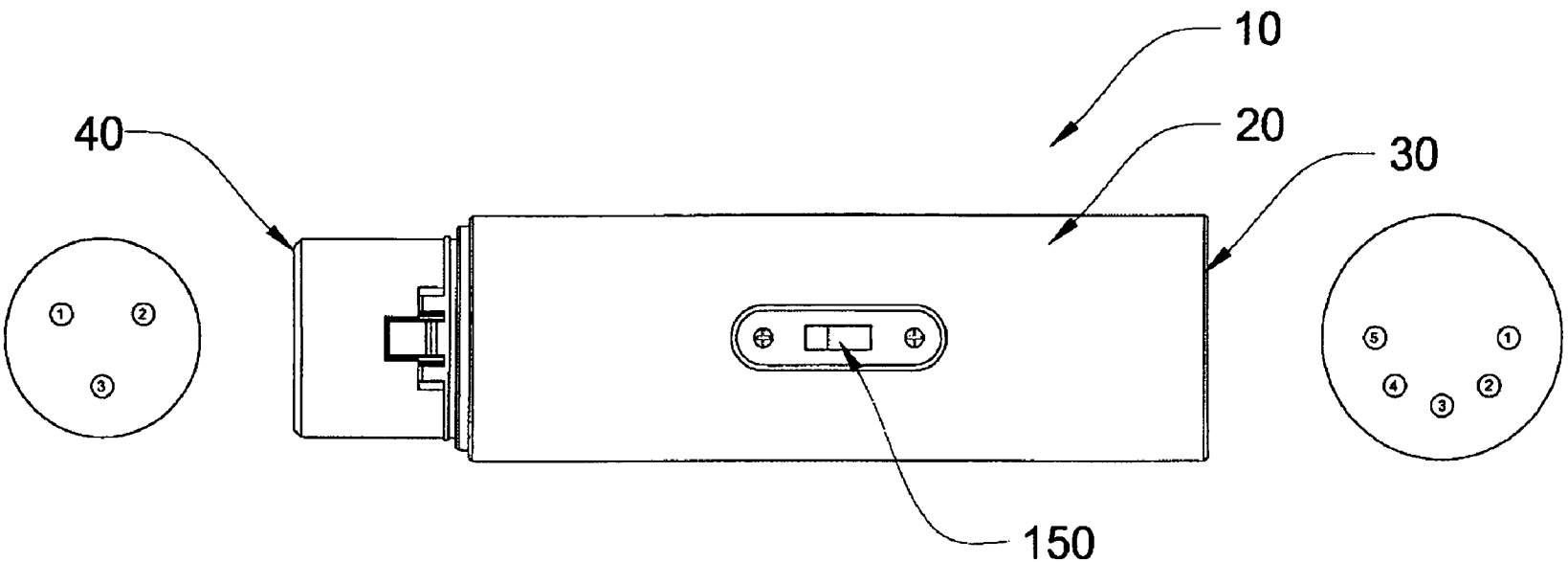
FIG. 1: elevation view of the invention.
Figure 2:
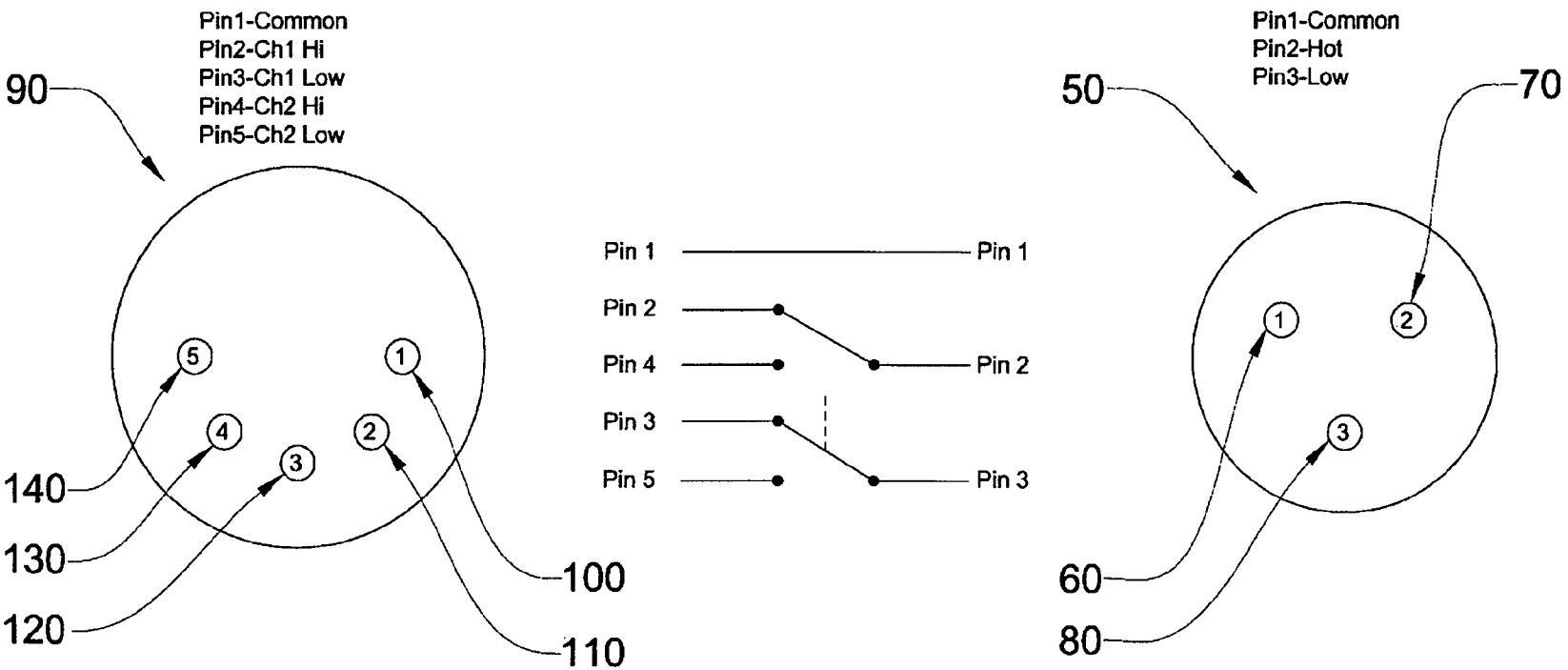
FIG. 2: exploded view of 5-pin 3-pin electrical connectors.

Referring to FIGS. 1 and 2, the Switch 10 is comprised of a housing body 20, said housing comprises a first end 30 and a second end 40. In the preferred embodiment, the housing 20 is a 1" diameter cylinder fabricated from electrically nonconductive material by a molding operation.

The first end 30 comprises a 3-pin electrical connecter 50, where said pins are: 3-1 60 (a ground pin); 3-2 70 (a Hi pin); and 3-3 80 (a Lo pin). The second end 40 comprises an 5-pin electrical connector 90, where said pins are: 5-1 100 (ground pin); 5-2 110 (Channel One Hi pin); 5-3 120 (Channel One Lo pin); 5-4 130 (Channel Two Hi pin); and 5-5 140 (Channel Two Lo pin).

The housing body also comprises a two position electrical switch 150, where the switch can be paced in position 1 or position 2 without disconnecting the 3-pin 50 or 5-pin 90 electrical connectors; said switch has an operating end and a connector end.

The three pin 50 and five pin 90 electrical connectors are electrically connected by the electrical switch 150 to form two sub-circuits. The first sub-circuit connects pins: (a) pin 3-2 70 to pin 5-2 110; and (b) pin 3-3 80 to pin 5-3 120. The second sub-circuit connects: (a) pin 3-2 70 to pin 5-4 130; and (b) pin 3-3 80 to pin 5-5 140. When the electrical switch 160 is in position 1 the first sub-circuit is chosen and conversely, when the electrical switch 160 is in position 2, the second sub-circuit is chosen. Pins 3-1 60 and 5-1 100 are the ground pins; each has the same function and do not pass through the switch.

What is claimed:

1. A switched electrical adapter for a three pin XLR audio connector and a five pin connector XLR audio connector comprises:

a. an electrical connector having three pins (3-1, 3-2, and 3-3), said pin 3-1 being a ground pin, said pin 3-2 being a HI pin, and said pin 3-3 being a LO pin, b. an electrical connector having five pins (5-1, 5-2, 5-3, 5-4, and 5-5), said pin 5-1 being a ground pin, said pin 5-2 being a Channel One HI pin, said pin 5-3 being a Channel One LO pin, pin 5-4 being a Channel Two HI pin, and said pin 5-5 being a Channel Two LO pin, c. a two position electrical switch, said positions being described as position 1 and position 2, having an operating end and a connector end, d. said three pin and five pin electrical connectors electrically connected with said electrical switch to form two sub-circuits, e. the first of said sub-circuits connecting said pins as follows (i) pin 3-2 to pin 5-2

(ii) pin 3-3 to pin 5-3 f. the second of said sub-circuits connecting said pins as follows (i) pin 3-2 to pin 5-4

(ii) pin 3-3 to pin 5-5 g. said first sub-circuit being selected by positioning said switch in position 1, h. said second sub-circuit being selected by positioning said switch in position 2, i. pin 3-1 is connected directly to pin 5-1 j. means for enclosing said connectors such that said two position switch can be repositioned from Position 1 to Position 2 without disconnecting said five pin and three pin electrical connectors.

* * * * *